US005892790A

United States Patent [19]

Abiko et al.

[11] Patent Number: 5,892,790

[45] Date of Patent: Apr. 6, 1999

[54] COLD CRUCIBLE INDUCTION FURNACE

[75] Inventors: Kenji Abiko, 27-9, Takamori 6-chome, Ikumi-ku, Sendai-shi, Miyagi-ken; Hitoshi Kawano, Ise; Masanori Tsuda, Ise; Tadahito Nakajima, Ise, all of Japan

[73] Assignees: Kenji Abiko, Sendai; Shinko Electric Co., Ltd., Tokyo-to, both of Japan

[21] Appl. No.: 939,652

[22] Filed: Sep. 29, 1997

[30] Foreign Application Priority Data

Sep. 30, 1996 [JP] Japan ..... 8-276902

[51] Int. Cl.[6] ..... H05B 5/16

[52] U.S. Cl. ..... 373/158; 373/158

[58] Field of Search ..... 373/151–156, 373/158

[56] References Cited

U.S. PATENT DOCUMENTS 5,283,805 2/1994 Kawano et al. ..... 373/156

OTHER PUBLICATIONS

Patent Abstracts of Japan, JP 07 248190, Sep. 26, 1995.
Patent Abstracts of Japan, JP 07 249483, Sep. 26, 1995.
Patent Abstracts of Japan, JP 08 313164, Nov. 29, 1996.

*Primary Examiner*—Tu Ba Hoang
*Attorney, Agent, or Firm*—Oblon, Spivak, McClelland, Maier & Neustadt, P.C.

[57] ABSTRACT

A cold crucible induction melting furnace is provided with a plurality of segments separated by a plurality of slits that surround a bottom member which together form the melting chamber. Each lower end of each segment is overlapped with and spaced from a short part of a vertically extending side wall of the bottom member so as to form a horizontal gap there between. A radially and outwardly extending flange protrudes from the bottom member side wall below each segment lower end to form a lower gap there between. An induction coil is disposed around and spaced from an outer face of the segments with a lower end adjacent to each of the lower segment ends and an upper end adjacent to an upper part of each segment that is in turn connected with an adjacent upper segment part to form a short circuited part. The radial thickness of each segment from the upper end of the coil to the lower end of the segments is the same and the magnetic flux generated by the induction coil passing through the lower gap and the horizontal gap provides increased magnetic flux density at least adjacent to the region adjacent to the bottom member and the lower ends of the segments.

7 Claims, 7 Drawing Sheets

FIG. IA
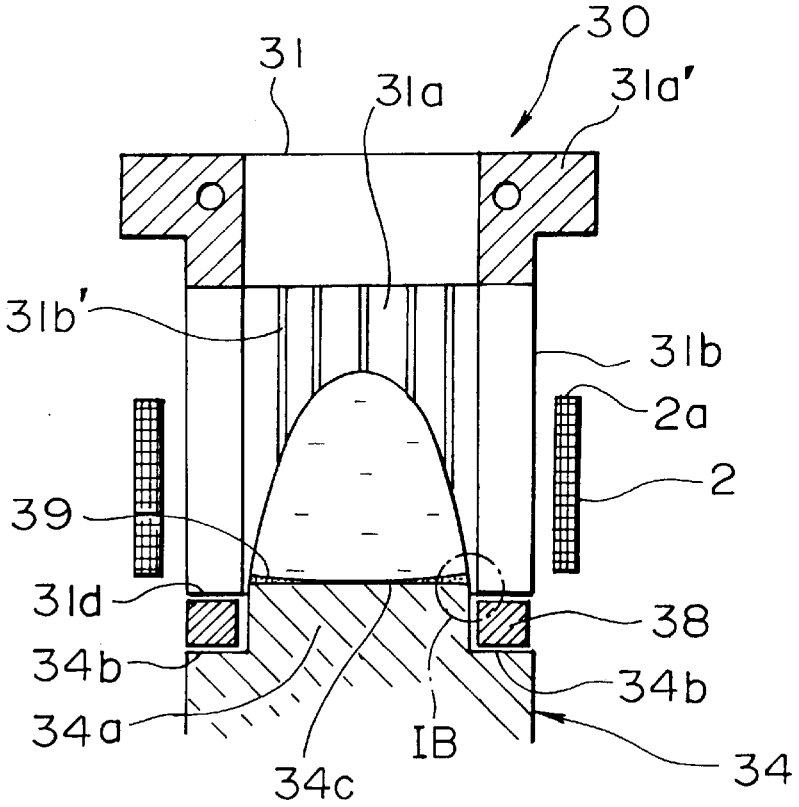
FIG. IB
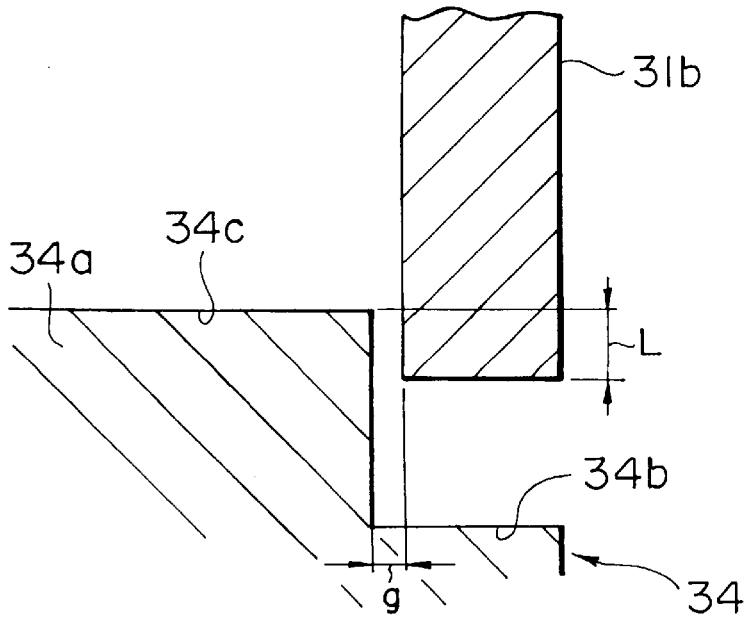

COLD CRUCIBLE INDUCTION FURNACE

TECHNICAL FIELD

The present invention relates to a cold crucible induction furnace using induction heating, for reducing the amount of skull of solidified parts caused by molten material having been contacted with the cooled crucible body in melting cooled by the cooling water or the like, with an intention to reduce the amount of the solidified portion of the molten material.

BACKGROUND ART

The shape of the segmented cold crucible, a side wall of the crucible body of the so-called cold crucible melting, is classified into two types of the first and second types as follows.

1) A first type conventional melting furnace a) As shown in FIG. 6, a water cooled copper crucible 1 as a furnace body is constructed as having a side wall 1*a*, a bottom wall 1*d* and a bottom part 4 placed further under the bottom wall 1*d*.

At the bottom of the side wall 1*a* of the crucible 1, a bottom flange 1*c* formed by extending radially and outwardly from the base part of the bottom, a flange 4*a* corresponding to the flange 1*c* extending also radially from the top face of the bottom part 4 and they are connected by bolts 7.

While, the side wall 1*a* of the metallic crucible having a shape of a hollow bottomed cylindrical shape is split into a plurality of segments 1*a*' by a plurality of slits 1*b* extending vertically.

Each of the segments 1*a* has within its interior a double walled tube 5 divided into an inlet and an outlet opening for a cooling water, each of them is connected to an inlet passageway 5*a* and an outlet passageway 6*a* and they constitute a segment and a crucible of a water cooled metallic crucible body as an integrated body of these segments 1*a*'.

b) The crucible body comprises an induction heating coil 2, which is placed surrounding the outside wall face of the aforesaid water-cooled segments 1*a*' and is supplied by high frequency or intermediate frequency electric power to melt the metal or metals received in the crucible by induction heating without contacting with the crucible inner face, and c) a supply and a control system for supplying and controlling the above-mentioned melting power and cooling water.

To summarize, the conventional first type cold crucible 1 is split into a plurality of segments 1*a*' by slits 1*b*, and each of these segments is composed of independently operable crucible side wall 1*a* having an inlet passage 5*a* and an outlet passage 6*a*, a bottom wall 1*d*, a bottom part 4, induction heating coil disposed around the crucible 1, pipes for cooling water for this coil and a supply and control systems for these power and water systems.

By virtue of this construction, metal or metals to be melted which are supplied into the crucible are induction heated by subjecting to exposure to alternating current supplied to this coil or coils and are melted to a molten metal or alloy in the crucible.

The upper surface of the molten metal, due to the balance of power caused by electric magnetic power acting on the upper surface of the molten metal or alloy and to the static pressure given by the weight of the molten metal or alloy, will be raised upwards being separated from the inside face of the side wall of the crucible and is kept as a dome-like molten metal 3, while the lower bottom of the molten metal 3, the interior of the side wall 1*a* and between the top face of the bottom wall 1*d* is kept as a skull 9 as a skin of solidified metal formed by the water-cooled copper crucible.

2) A second type conventional cold crucible melting furnace

Following are features different from the above-mentioned first type cold crucible melting furnace.

As shown in FIGS. 7A and 7B, a plurality of segments 13 form a side wall of a plurality of pairs 13*a* and 13*b* of two adjacent ones, the one of which 13*a* forms an inlet passage 15*a* and the other of 13*b* has an outlet passage 15*b* which is communicated with outlet passage 15*a* at the top, and these pair of segments 13*a* and 13*b* function to constitute two legs of a unit segment.

Each of these unit segments are divided, at least at this portion from their bases up to the upper portion 13*d*' into two portions, by a slit 14*a*, and the lower portions 13*d* and 13*e* are also divided into two portions by a slit 14*b* which is contiguous to the above-mentioned slit 14*a* and constitute a radially and outwardly extending flanges 13*d* and 13*e*, and thereby they constitute L shaped legs and feet as shown by FIG. 7B. The bottom portion 17 is fabricated separately of the segments 13, and the bottom portion 17 is inserted within the inner space defined by the bottom of the side wall 13*b* as a collected body of the unit segments through the insulating material 18 as shown in FIG. 7A.

When the second type cold crucible furnace is compared with the first type one, there is observed almost same the structural features with respect to the induction coil and its pipings for a cooling water explained in item b) and supply and control means to supply melting power and cooling water as explained in item c) are substantially the same, so further explanation will not be repeated.

The drawbacks of the first type conventional cold crucible melting furnace is, that the molten metal kept non-contacted with the side wall of the crucible is kept at molten state, however, at the bottom it has no magnetic flux at its portion other than its outside region, and in addition, these two portions are contacted with each other since they are not sustained by the magnetic flux at these portions.

Due to these reasons, at the part lower than the central portion of the molten metal raised upward like a dome, there is a solidified portion called skull 9 as shown in FIG. 6. which is attributable to degrade the melting efficiency.

Particularly, the portion where the skull contacts the interior part of the side wall of the crucible not only makes the heat conductivity loss larger, but also even the heat induction from the surface does not contribute to improve the efficiency of melting.

In the second type conventional cold crucible furnace as compared with the first type one, there are following differences.

When the side wall of the crucible is situated on the radial extension of the upper face of the crucible bottom, the passage of the magnetic flux at the bottom portion mainly passes its slit portions.

This is because the magnetic resistance passing through the portions $L_1$ and $L_2$ is larger than that passes from the slit as shown in FIG. 7B.

And yet as shown in FIGS. 7A and 7B, side wall of the crucible is formed to have an L shaped cross section, the coils so as to avoid this L shaped crucible wall, must be moved upwards, or the diameter of the coils must be enlarged, however, the enlargement of the coil is inevitable and greatly lowers its efficiency as a whole.

By taking either way of 1) or 2), it results in lowering the magnetic flux density of the system.

SUMMARY OF THE INVENTION

In order to solve the above-mentioned problems following means have been taken.

a) Improving the electric magnetic force by increasing the magnetic flux at the crucible bottom, b) Shutting off the path of thermal conductivity from the molten metal by making two adjacent portions separated, that is, by separating the molten metal and side wall of the crucible, c) To make the induction heating power at these portion contribute to the heating, thereby to decrease the electric power to maintain the molten state, d) Increasing the melting power efficiency to decrease the amount of skull.

By taking all the above-mentioned steps in practice and making all the charged metals to be molten, the object of the present invention have been achieved.

BRIEF DESCRIPTION OF DRAWINGS

The invention will now be described by way of examples and with reference to the accompanying drawings in which:

FIG. 1A is a drawing illustrating the first embodiment of the present invention as a sectional view illustrating the first embodiment of the present invention, and FIG. 1B illustrating an enlarged major part shown by a part of 1B of FIG. 1A; FIGS. 3A–3C are drawings illustrating the third embodiment of the invention, wherein FIG. 3A is a sectional view and FIG. 3B illustrating a perspective view shown by line IIIB, and FIG. 3C is the drawing a partially sectional view showing another embodiment of the present invention, and FIGS. 4A and 4B are drawings illustrating fourth embodiment of the present invention, wherein FIG. 4A is a sectional view of the fourth embodiment of this invention and FIG. 4B is a perspective view of FIG. 4A taken along line IVB of FIG. 4A; and FIG. 5 shows graphs, in which FIGS. 7A and 7B are views illustrating the second type conventional cold crucible induction furnace, wherein FIG. 7A is a perspective view and FIG. 7B is a half part sectional view taken along line VIIB—VIIB of FIG. 7A.

DETAILED DESCRIPTION OF THE INVENTION

Figure 2:
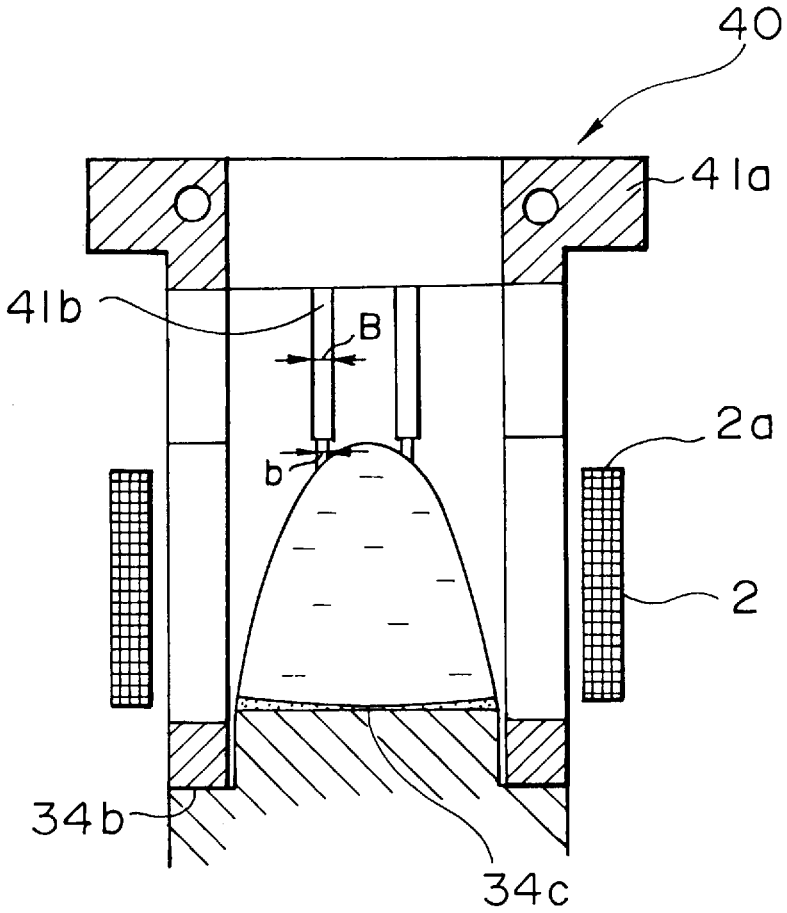
FIG. 2 is a sectional view illustrating the second embodiment of the present invention.

Throughout the invention shown in FIGS. 1 through 4, the crucible structures of the present invention have following features as mentioned below.

(1) Inside surface of the segment of the side wall of the crucible at least at its lower portion is situated apart from the outside surface of the bottom wall, so the inside surface of the crucible and bottom wall are mutually separated and not short-circuited with the metal in the bottom of the crucible.

(2) The lower part of the crucible between other parts are insulated, that is, insulated by non-metallic material(s) or kept spaced.

These structural differences will be explained by referring to FIG. 1A and FIG. 1B as an embodiment of the present invention.

The side wall 31 of the crucible 30 of the embodiment of this invention is having been inverted the lower portion 1*a* of the conventional first type segments up, and the upper portion 31*a*' is made contiguous to be extended towards radially and outwardly as shown in FIG. 1A and constitutes the short circuited portion.

The leg portions 31*b* lower than the short circuited portion 31*a*' of the segments 31*a* constitutes a plurality of slit 31*b*' between the adjacent segments, and the space lower than the lower end portions 31*b*, as shown in the partial enlarged view FIG. 1B, by keeping a vertically overlapped length L and a horizontal gap "g", a head of convexed head 34*a* of bottom portion 34 is inserted. And the portion between the lower end of the aforesaid legs 31*b* and the shoulder portion 34*b* of the bottom part 34 an insulating nonmetallic material or the like is disposed or kept spaced. The head portion 34*a* of the convexed head is inserted, keeping overlapped portion L and a horizontal gap g as shown in FIG. 1B. Between the lower end portions 31*b* of the segments and the top portion of the shoulder portion 34*b* are either fitted with an insulating material 38 or it is kept vacant as the insulating material has been removed. The above-mentioned value of L must be kept lower than 5 mm, and if it becomes zero, that is, there remains no overlapped portion, there arises leakage of molten metal or a reaction between the non-metallic material. So it is necessary to keep the value of "L" to be kept so close to zero such that there arise no leakage of the molten metal. The value of "g" must be taken in such a manner as there arises no leakage of molten metal and it is usually less than 0.5 mm.

As it is difficult to set the value to zero, it is desirable to set the lower limit to be made such that the convexed head 34*a* can be insertable. Mutual gaps between respective segments 31*a* is formed by slits 31*b*', and the side wall of the crucible is formed by the collected body of the segments 31*a*, around which induction coil 2 is disposed.

The slits 31*b*' are positioned above the top portion 2*a* of the coil and extended further towards the lower end of short circuited portion 31*a*'. By virtue of this construction., the skull 39 formed during melting is formed as a thin plate along the lower end of side wall and the convexed upper end of the bottom.

Figure 5B:
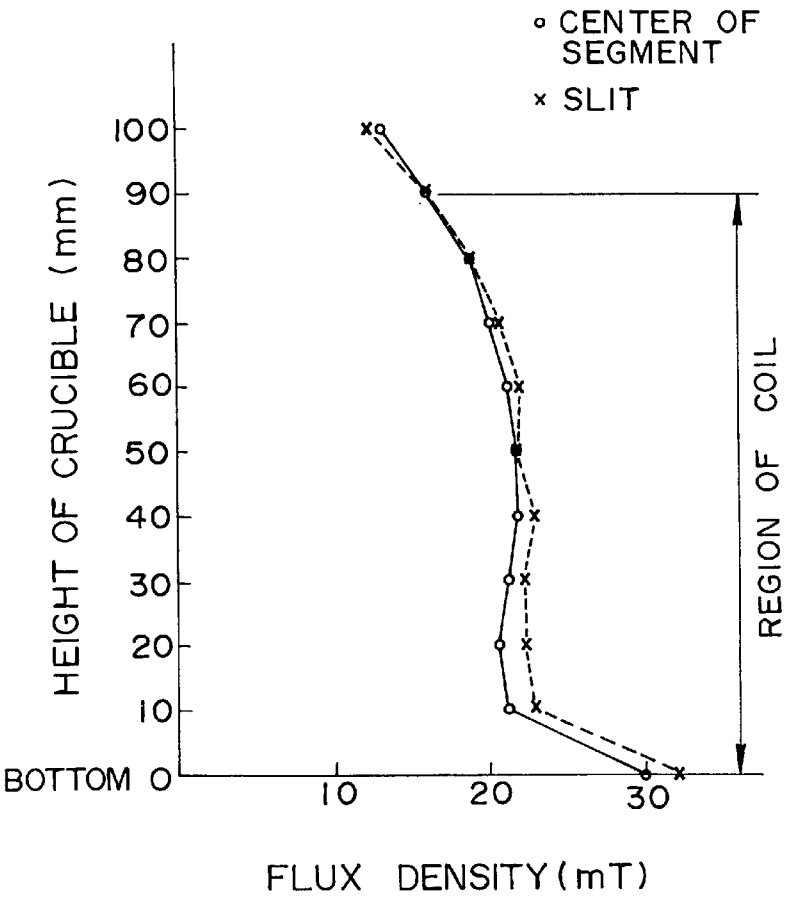
FIG. 5B is a graph showing height of the crucible in (mm) versus magnetic flux density in (mT) of the embodiment of the present invention in comparison with FIG. 5A of the conventional crucible in the same condition.
Figure 5A:
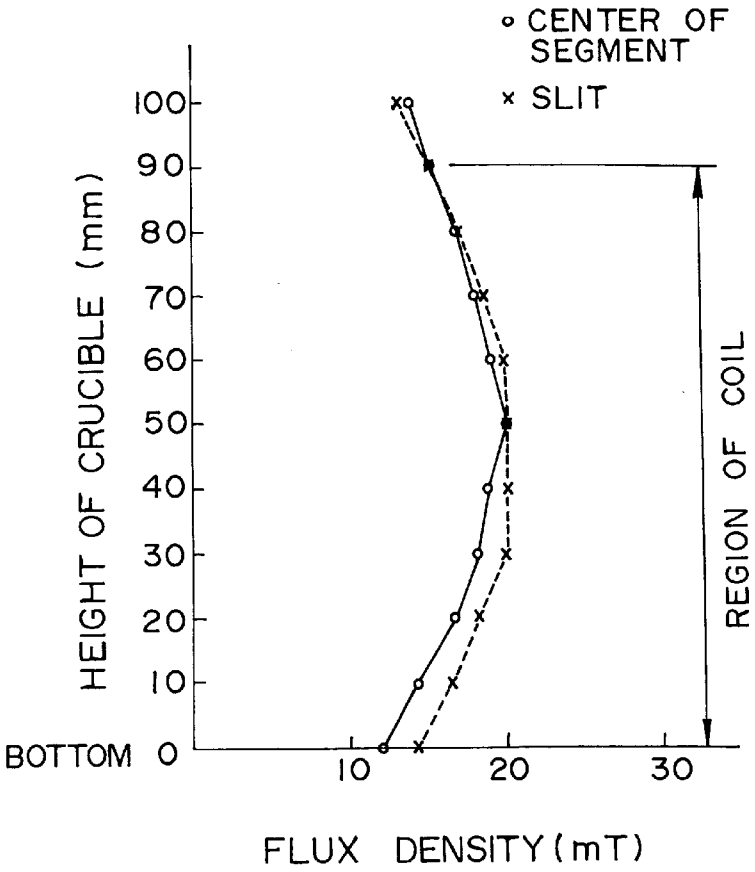
Figure 6:
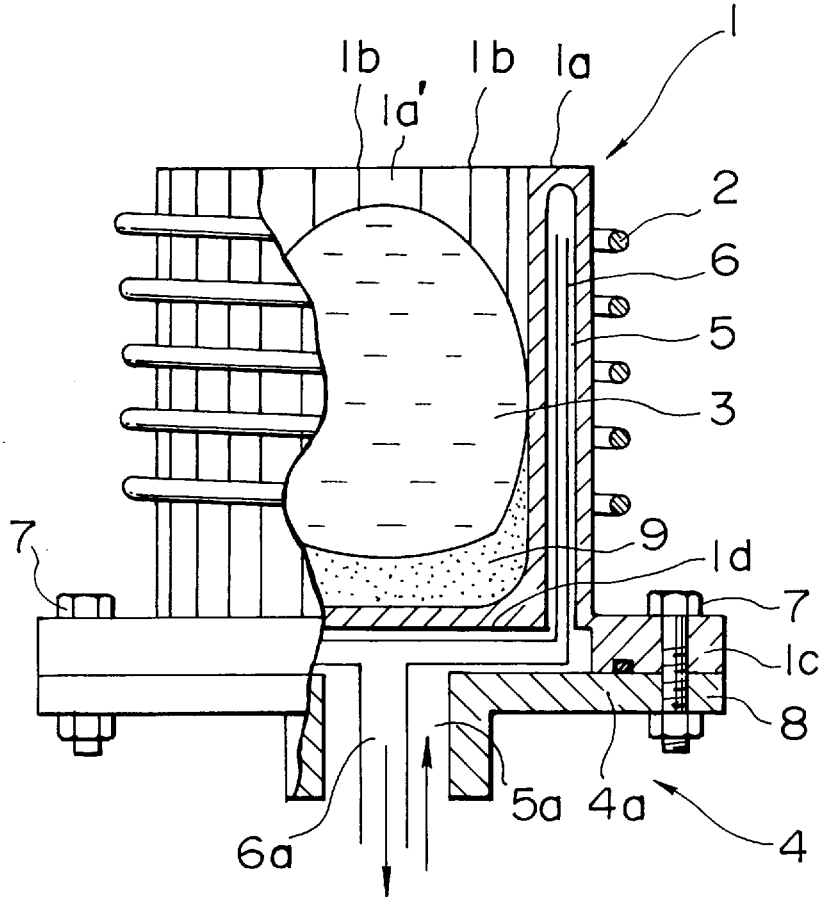
FIG. 6 PRIOR ART
FIG. 6 is a sectional view showing the first type conventional cold crucible induction furnace.

Next, by comparing the first type embodiment of the crucible of the present invention with the conventional one, we will show FIGS. 5A and 5B to know what extent of magnetic flux could be increased.

Both the present invention and the conventional one use the same crucible having the same inner diameter of 158 mm, height of 90 mm and the same turn number of 6 and the same current ampere of 647×6 turns=388A turn and frequency number of 8.5 KHz.

Thereby, measuring the circumferentially central part of the magnetic flux density on the slits and the inner face of each of circumferentially central part of the segments and these values have been shown as a cross dashed line and an actual line.

In addition, in FIG. 1B showing the first embodiment of the present invention, L=1.5 mm and the slit length was set to 148.5 mm.

According to this result, it is confirmed that the magnetic flux density in the conventional cold crucible furnace is, as shown in FIG. 5A high at the central part of the crucible where the coil exists and it becomes weaker towards its bottom.

And it is also confirmed that the magnetic flux density at the portion near the inner wall of the crucible is somewhat higher than that of the central part of the segments.

On the other hand, according to the results shown in the FIG. 1B of the first embodiments of the present invention, both the flux density at the inner face of the slits and that central part of the part are almost the same value. And this shows that the magnetic flux density at the portion near the bottom portion is higher than that at the central part where the coil exists.

And this measurement is done at the part where there is charged no material to be melted in the crucible, but it is expected that the same inclination could be obtainable.

Next, the second embodiment of this application will be explained by referring to FIG. 2.

This relates to a second embodiment where the circumferential breadth B of the slits 41*b* is made larger than the slits 31*b*' of the first embodiment by making the uppermost position 2*a* of the coil 2 higher than that of the first embodiment and thereby reducing the magnetic resistance as a whole and increasing the magnetic resistance of the crucible and 34*b* is an insulating material or a vacant portion.

Figure 3A:
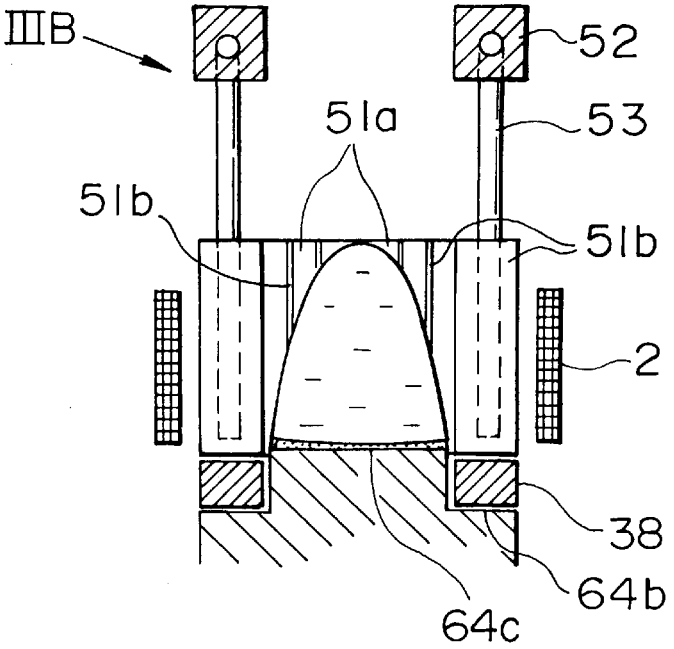
Figure 3B:
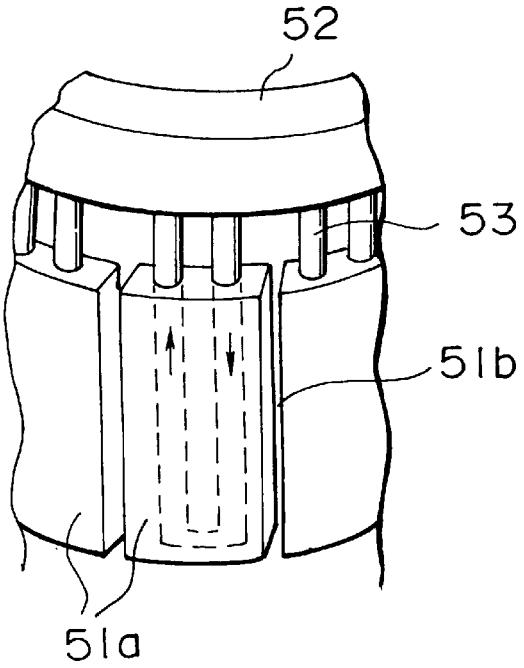

A third embodiment a) as shown in FIG. 3A and its perspective view FIG. 3B shown by arrow line IIIB, has been intended to increase further the meritorious effect of the second embodiment by increasing the slit breadth. That is, each segment and circuited portion situated above have been separated, and fixed short circuited portions 52 have been installed in place of the short circuited portion 41*a* and these two portions are connected by cooling water pipings 53, by using this cooling water piping, meritorious effects of the second embodiments by widening the breadth of the slits have been increased.

Figure 3C:
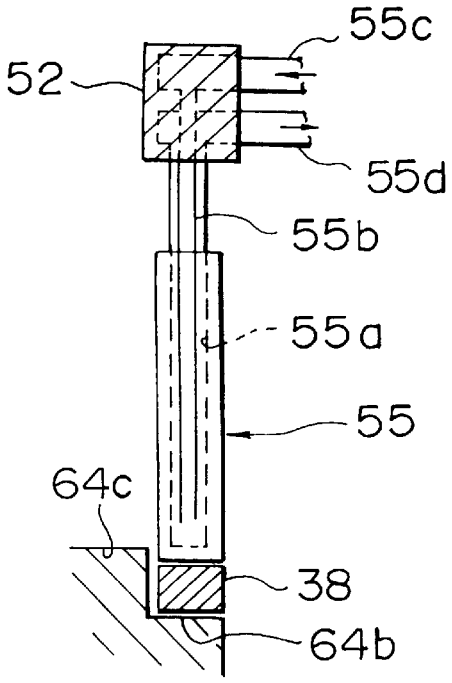

The third embodiment itemised as a) is an example where the water connecting tubes have been provided as an inlet tube and an outlet tube in each segment, however, as a partially alternative embodiment b) of the third embodiment as shown in FIG. 3(C), there is another construction wherein each segment 55 has another inner tube 55*b* inserted therein to be connected with another inlet water passage 55, while the space between the inner tube 55*b* and the inner hole 55*a* outside the inner tube 55*b* is connected with an outside outlet water pipe 55*d* and thereby uses the installed short circuit 52 used as a branch cock.

Figure 4A:
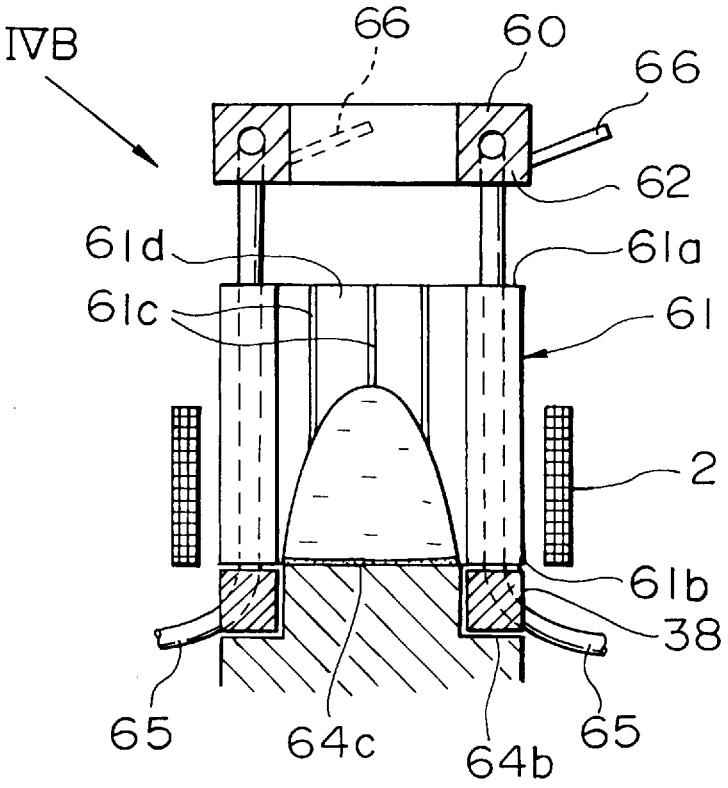
Figure 4B:
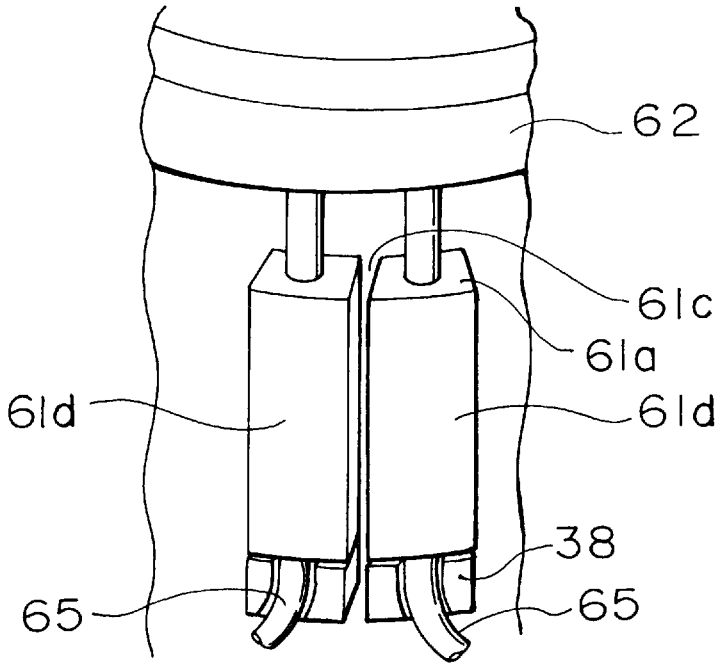

The fourth embodiment of the present invention will be explained by referring to FIG. 4A and its perspective view FIG. 4B seen along line IVB. Each segments 61 is divided into a plurality of pieces by slit 61*c* and its upper end 61*a* and lower end 61*b* are connected with cooling water tubes 65 and 66, and at the upper end is connected, as in the third embodiment, with cooling water supply or discharge pipe 66. The cooling water supply or discharge pipe 65 at the lower end is slanted at its lower part to avoid coil 2, the crucible lower end 61*b* and the top of shoulders 64*c*.

The structural features shown in the first to fourth embodiment of the present invention are different from that of the first and second prior arts, firstly, there does not exist any radially and outwardly extending flange portion at the bottom, that is, magnetic resistance becomes larger if the flange extends radially longer as in the prior art ones.

In addition, the supply water connecting tube of the prior arts is at the lower ends of the crucible body, while in the embodiments of the present invention the supply water connecting tube is positioned at the upper end part of the crucible body.

Accordingly, as there is no restriction on the position of the coil in the present invention, the coil can be placed at a position where the magnetic resistance can be made smaller, the present invention can solve the pending problems in the prior art ones where there is a restriction on the position of the coils due to the L-shaped cross section of the crucible wall in the bottom part of the prior arts.

1) By making the path of the magnetic flux in the crucible bottom portion of non-magnetic material or a space, it is possible to decrease the magnetic resistance of the portion adjacent to the lower bottom of the crucible and to greatly increase the magnetic resistance both at the crucible side wall and at the surface of the bottom portion.

As a consequence, it is possible to make uniform and increase the electromagnetic force of the top portion to be dome shaped to the bottom surface of the molten metal, thereby it becomes possible to keep the inner wall surface and the molten metal to be non-contacted.

In order to keep the molten metal to be separated from the inner face of the crucible, the magnetic flux density becomes higher at the portion adjacent to the bottom portion of the crucible, so it is effective to decrease the magnetic resistance adjacent to this portion to increase both the magnetic flux density and magnetic flux.

In the conventional cold crucible furnaces, the magnetic flux has only to pass through the slit portion, however, in the present invention the magnetic flux can pass through both the side wall and the bottom portion of the crucible, and yet it can pass through the slits between the side walls and the bottom of crucible and also passing through towards the coil lower ends along the terminal ends of the crucible, it can increase the magnetic flux at the bottom of the crucible.

However, if the lower ends of the crucible are much lower than the upper face of the crucible, it becomes closer to the second type conventional cold crucible, the magnetic flux passes only through the slits and thereby meritorious effects of the invention will be decreased.

Accordingly, the length L from the top of the convexed face 34*c* to the lower end of the crucible 31*b* must be slightly below the upper face of the convexed top face 34*c* of the bottom, for example the lowermost possible end of it is 5 mm.

Figure 7A:
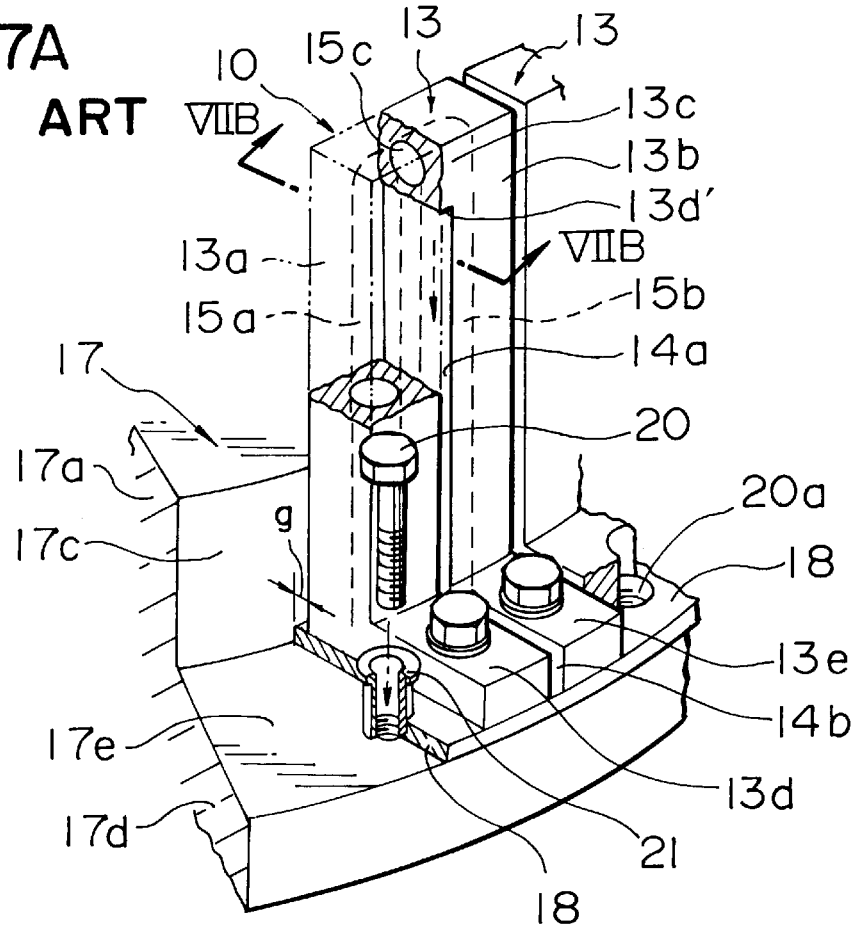
FIG. 7A PRIOR ART
Figure 7B:
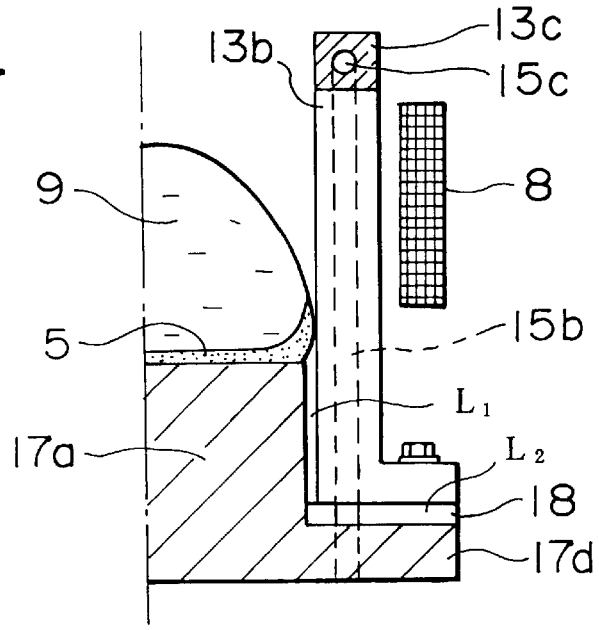
FIG. 7B PRIOR ART

It is supplemented that the drawbacks of the above-mentioned crucible, if the value of $L_1$ and $L_2$ of the FIG. 7B become larger, magnetic resistance will become larger and the magnetic flux is difficult to pass through the portion and thereby the magnetic flux near the bottom of the crucible pass through the slits and return to the coils.

2) Due to the meritorious effect of aforesaid item 1) , since the thermal conductivity by contacting with the side wall of the crucible becomes zero, in addition, this portion is also induction heated, so heat is also supplied to this portion.

3) By virtue of the effects as explained in item 2), since the heat conductivity is mainly applied to the bottom of the crucible, it can reduce the thickness of the solidified portion (skull) formed there.

We claim:

1. A cold crucible induction melting furnace comprising:

a plurality of vertically extending segments separated by a plurality of vertically extending slits;

a bottom member surrounded by said segments defining a chamber into which the material to be melted is placed;

each of said segments having a passage therein configured to receive cooling water and a lower segment end overlapping with and spaced from a short part of a vertically extending bottom member side wall so as to form a horizontal gap between said bottom member sidewall and each lower segment end;

a radially and outwardly extending flange on said bottom member protruding from said bottom member side wall at a position spaced below each lower segment end to form a lower gap between a bottom of each lower segment end and an upper face of said flange;

an induction coil disposed around and spaced from an outer face of said segments said coil having a lower coil end adjacent to each said lower segment end and an upper coil end adjacent to an upper segment portion of each said segment that is connected with an adjacent upper segment portion to form a short circuited portion wherein a radial thickness of each segment portion extending between the upper coil end and the bottom of the segment lower end is the same; and wherein magnetic flux generated by the induction coil can pass through each slit and through the lower gap and the horizontal gap to provide increased magnetic flux density at least adjacent to each said lower segment end.

2. The cold crucible induction melting furnace as claimed in claim 1, wherein at least one of said lower gap and said horizontal gap is filled with non-metallic material.

3. The cold crucible induction melting furnace as claimed in claim 1, wherein at least one of said lower gap and said horizontal gap is an unfilled space.

4. The cold crucible induction melting furnace as claimed in claim 1, wherein cooling water piping having thinner thickness than that of the segments is connected to each passage through each lower segment end.

5. The cold crucible induction melting furnace as claimed in any one of claims 1–3 or 4, wherein the width of each vertically extending slit is wider at an upper portion above the upper coil end than at a lower portion below said upper coil end.

6. The cold crucible induction melting furnace as claimed in claim 1, wherein said horizontal gap has a width that is less than 0.5 mm.

7. The cold crucible induction melting furnace as claimed in any one of claims 1–3 or 5 wherein cooling water piping is connected to each passage through the short circuited portion.

* * * * *